US008137531B2

(12) United States Patent
Farshid et al.

(10) Patent No.: US 8,137,531 B2
(45) Date of Patent: Mar. 20, 2012

(54) INTEGRATED PROCESS FOR THE PRODUCTION OF LUBRICATING BASE OILS AND LIQUID FUELS FROM FISCHER-TROPSCH MATERIALS USING SPLIT FEED HYDROPROCESSING

(75) Inventors: Darush Farshid, Larkspur, CA (US); Richard O. Moore, Jr., San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 2186 days.

(21) Appl. No.: 10/702,751

(22) Filed: Nov. 5, 2003

(65) Prior Publication Data

US 2005/0092653 A1 May 5, 2005

(51) Int. Cl.
*C10G 51/02* (2006.01)

(52) U.S. Cl. ..... 208/78; 208/80; 208/950

(58) Field of Classification Search ..... 208/78, 208/80, 950

See application file for complete search history.

(56) References Cited

U.S. PATENT DOCUMENTS

| | | | | |
|---|---|---|---|---|
| 4,073,718 | A | 2/1978 | Hammer | |
| 4,283,271 | A | 8/1981 | Garwood et al. | |
| 4,283,272 | A | 8/1981 | Garwood et al. | |
| 5,378,348 | A | 1/1995 | Davis et al. | |
| 5,403,469 | A | 4/1995 | Vauk et al. | |
| 5,453,177 | A | 9/1995 | Goebel et al. | |
| 5,980,729 | A | 11/1999 | Kalnes et al. | |
| 6,036,844 | A | 3/2000 | Gupta et al. | |
| 6,096,191 | A | 8/2000 | Kalnes | |
| 6,153,086 | A | 11/2000 | Gupta et al. | |
| 6,179,995 | B1 | 1/2001 | Cash et al. | |
| 6,224,747 | B1 | 5/2001 | Cash et al. | |
| 6,337,010 | B1 | 1/2002 | Hofer | |
| 6,387,245 | B1 | 5/2002 | Kalnes et al. | |
| 6,432,297 | B1 | 8/2002 | Kalnes et al. | |
| 6,475,375 | B1 * | 11/2002 | Dancuart | 208/78 |
| 6,589,415 | B2 | 7/2003 | Smith et al. | |
| 6,605,206 | B1 * | 8/2003 | Johnson et al. | 208/80 |
| 6,656,343 | B2 * | 12/2003 | Dancuart | 208/58 |
| 2002/0179488 | A1 * | 12/2002 | Dancuart | 208/58 |
| 2003/0150777 | A1 * | 8/2003 | Johnson et al. | 208/97 |

FOREIGN PATENT DOCUMENTS

| | | | |
|---|---|---|---|
| EP | 0 264 158 | B1 | 8/1991 |
| EP | 776959 | A2 * | 6/1997 |
| WO | WO 02/26917 | A1 | 4/2002 |
| WO | WO 03/086567 | A1 | 10/2003 |

* cited by examiner

*Primary Examiner* — Thuan Dinh Dang
(74) *Attorney, Agent, or Firm* — A. Stephen Zavell

(57) ABSTRACT

An integrated process for producing liquid fuel and lubricating base oil from Fischer-Tropsch derived products which comprises (a) recovering separately from a Fischer-Tropsch synthesis reactor a Fischer-Tropsch wax and condensate; (b) hydroprocessing the wax and recovering a waxy intermediate and a hydrogen-rich normally, liquid fraction; (c) mixing the condensate and at least part of the hydrogen-rich normally liquid fraction to form a Fischer-Tropsch condensate mixture; (d) hydrotreating the condensate mixture and recovering a Fischer-Tropsch condensate product; (e) recovering from the condensate product a liquid fuel; (f) separately dewaxing the waxy intermediate and recovering a base oil; (g) hydrofinishing the base oil; (h) recovering from the hydrofinishing zone a stabilized base oil and a hydrogen-rich gas; and (i) recycling the hydrogen-rich gas to the wax hydroprocessing zone wherein the total pressure in the hydrofinishing zone is at least as high as the total pressure in the wax hydroprocessing zone.

17 Claims, 1 Drawing Sheet

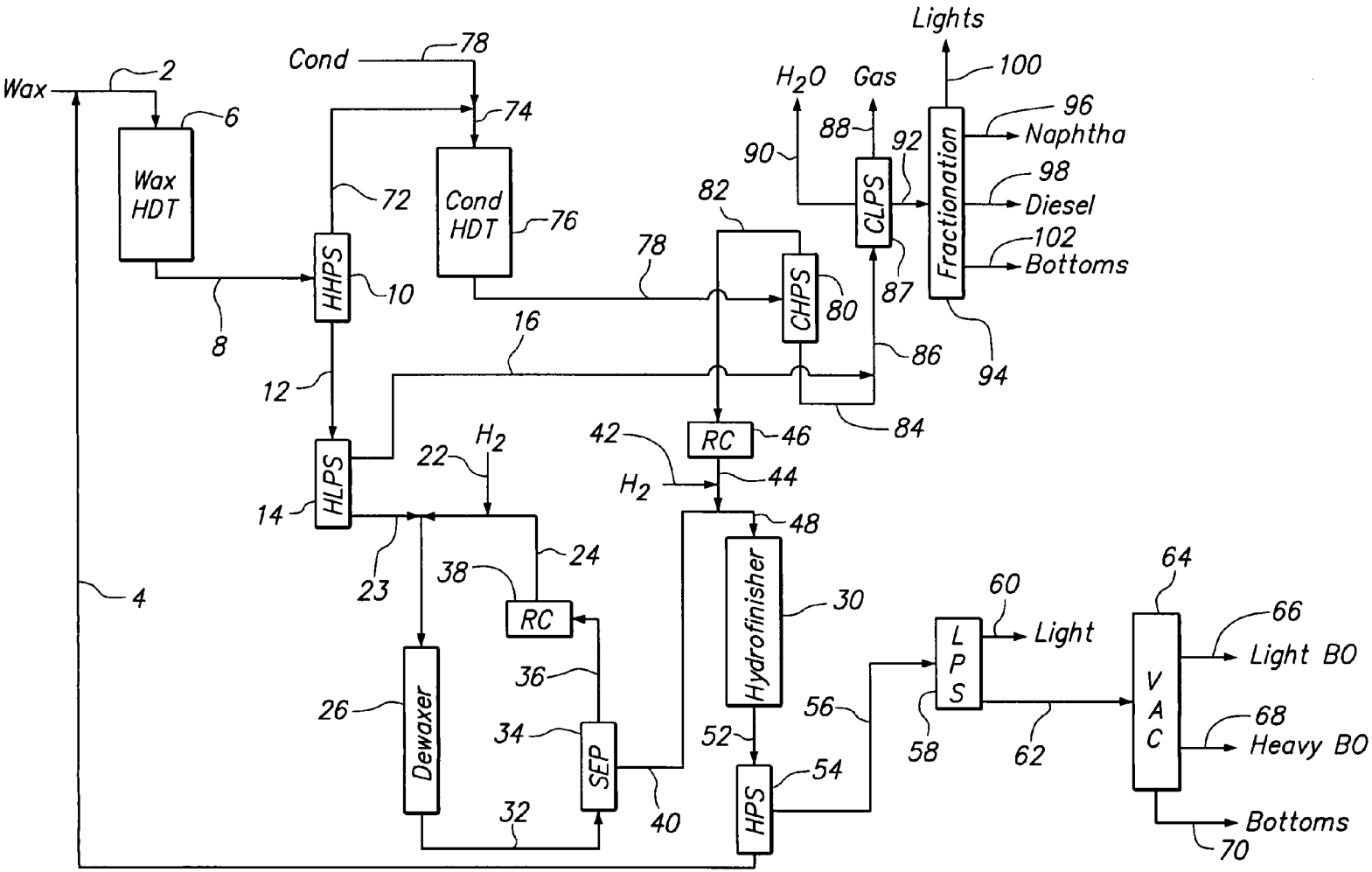
Wax
Wax HDT
Cond
Cond HDT
HHPS
HLPS
RC
CHPS
CLPS
Fractionation
Lights
Gas
$H_2O$
Naphtha
Diesel
Bottoms
$H_2$
Hydrofinisher
HPS
SEP
Dewaxer
LPS
Light
VAC
Light BO
Heavy BO
Bottoms

INTEGRATED PROCESS FOR THE PRODUCTION OF LUBRICATING BASE OILS AND LIQUID FUELS FROM FISCHER-TROPSCH MATERIALS USING SPLIT FEED HYDROPROCESSING

FIELD OF THE INVENTION

The present invention relates to the production of lubricating base oils and liquid fuels from Fischer-Tropsch derived hydrocarbons in which the Fischer-Tropsch wax and Fischer-Tropsch condensate are processed separately in an integrated processing scheme.

BACKGROUND OF THE INVENTION

The hydrocarbons recovered from the Fischer-Tropsch synthesis reactor usually may be classified into three categories based upon a combination of their molecular weight and boiling point. The lowest molecular weight fraction is normally gaseous at ambient temperature and also the least valuable commercially. Parts of this fraction, which are usually collected as overhead gases, may be sold as LPG, and/or upgraded by oligomerization to higher molecular weight material, or recycled to the Fischer-Tropsch synthesis unit. The Fischer-Tropsch condensate fraction which usually has a boiling range between about ambient temperature and about 750 degrees F. is normally liquid at ambient temperature and may be processed into liquid fuels intended for the transportation fuel market, such as, naphtha, jet, and diesel or used in petrochemical processing, such as ethylene cracking. The Fischer-Tropsch wax fraction which is generally a solid at ambient temperature may be cracked to yield lower molecular weight material suitable for use as liquid fuels or may be processed to yield lubricating base oils.

While the lubricating base oils derived from the Fischer-Tropsch wax fraction have a high potential commercial value, the processing schemes required to make their conversion to lubricating base oil generally require a high initial capital investment and involve high operating expenses. Therefore, most commercial processing schemes for Fischer-Tropsch wax crack the wax to yield lower value liquid fuels in order to avoid the high costs involved. The present invention is directed to an integrated process for producing both liquid fuels and high quality lubricating base oils. The integrated process of the invention lowers both the initial capital costs of the processing equipment and the high operating costs of the unit by processing the Fischer-Tropsch condensate fraction and the wax fraction in separate but fully integrated processing trains. The present processing scheme also makes it possible to operate each of the various processing steps under optimal process conditions which increase the yields of the highest value products.

The separate processing of heavy and light Fischer-Tropsch fractions has been proposed for the production of liquid fuels in U.S. Pat. Nos. 5,378,348 and 6,589,415. The separate processing of lubricating base oils and liquid fuels is proposed in U.S. Pat. No. 6,432,297. The optimization of the process conditions in each of the hydrocracking unit, dewaxing unit, and hydrofinishing unit during the production of lubricating base oil is taught in U.S. Pat. No. 6,337,010. However, none of the earlier processing schemes are able to take full advantage of the synergies associated with employing optimal processing conditions in the separate processing trains for the Fischer-Tropsch wax fraction and the Fischer-Tropsch condensate fraction.

As used in this disclosure the words "comprises" or "comprising" are intended as an open-ended transition meaning the inclusion of the named elements, but not necessarily excluding other unnamed elements. The phrases "consists essentially of" or "consisting essentially of" are intended to mean the exclusion of other elements of any essential significance to the composition. The phrases "consisting of" or "consists of" are intended as a transition meaning the exclusion of all but the recited elements with the exception of only minor traces of impurities.

BRIEF DESCRIPTION OF THE INVENTION

In its broadest aspect, the present invention is directed to an integrated process for producing Fischer-Tropsch derived products boiling in the range of liquid fuel and lubricating base oil which comprises (a) recovering separately from a Fischer-Tropsch synthesis reactor a Fischer-Tropsch wax and a Fischer-Tropsch condensate; (b) hydroprocessing the Fischer-Tropsch wax in a wax hydroprocessing zone by contacting the Fischer-Tropsch wax with a hydroprocessing catalyst in the presence of hydrogen under hydroprocessing conditions and recovering from the wax hydroprocessing zone a waxy intermediate and a hydrogen-rich normally liquid fraction; (c) mixing the Fischer-Tropsch condensate from step (a) and at least part of the hydrogen-rich normally liquid fraction from step (b) to form a Fischer-Tropsch condensate mixture; (d) hydrotreating the Fischer-Tropsch condensate mixture in a condensate hydrotreating zone by contacting the Fischer-Tropsch condensate mixture with a hydrotreating catalyst in the presence of hydrogen under hydrotreating conditions and recovering from the condensate hydrotreating zone a hydrotreated Fischer-Tropsch condensate product; (e) recovering from the hydrotreated Fischer-Tropsch condensate product a Fischer-Tropsch derived hydrocarbon boiling within the range of liquid fuel; (f) dewaxing the waxy intermediate from step (b) in a catalytic dewaxing zone by contacting the waxy intermediate with a dewaxing catalyst in the presence hydrogen under dewaxing conditions and recovering a base oil from the dewaxing zone; (g) hydrofinishing the base oil from step (f) in a hydrofinishing zone by contacting the base oil with a hydrofinishing catalyst in the presence of hydrogen under hydrofinishing conditions; (h) recovering from the hydrofinishing zone a UV stabilized lubricating base oil and a hydrogen-rich gas; and (i) recycling the hydrogen-rich gas from step (h) to the wax hydroprocessing zone of step (b) and wherein the total pressure in the hydrofinishing zone is at least as high as the total pressure in the wax hydroprocessing zone.

As used in this disclosure the phrase "Fischer-Tropsch derived" refers to a hydrocarbon stream in which a substantial portion, except for added hydrogen, is derived from a Fischer-Tropsch process regardless of subsequent processing steps. Accordingly, a "Fischer-Tropsch derived liquid fuel" refers to a liquid fuel which comprises a substantial portion of hydrocarbons boiling in the liquid fuel range which were initially derived from the Fischer-Tropsch process. Likewise, the phrase "Fischer-Tropsch derived lubricating base oil" refers to lubricating base oil which comprises a substantial portion of hydrocarbons boiling in the lubricating base oil range which were initially derived from the Fischer-Tropsch process. The Fischer-Tropsch derived liquid fuel or lubricating base oil may contain additives, and the Fischer-Tropsch derived hydrocarbons making up a substantial portion of the fuel or lubricating base oil will have undergone various processing operations, e.g., hydrotreating, catalytic dewaxing, and hydrofinishing. The Fischer-Tropsch derived liquid fuel or Fischer-Tropsch derived lubricating base oil may also contain some amount of conventional petroleum derived hydrocarbons so long as the conventional hydrocarbons do not comprise more than about 30 weight percent, preferably less than about 20 weight percent, of the total hydrocarbons present.

Although referred to in this disclosure as liquid fuels, it should be understood that the liquid products may also serve as feedstocks for petrochemical processing, such as ethylene cracking. Accordingly, the term "liquid fuels" refers to a liquid product boiling within the range of liquid fuels but not necessarily intended for use as a transportation fuel.

The phrase "hydrogen-rich normally liquid fraction" refers to a mixture of unreacted hydrogen and cracked hydrocarbons recovered from the hydroprocessing zone. Most of the cracked hydrocarbons will preferably boil in the range from about ambient temperature to about 750 degrees F. and will be suitable for processing along with the Fischer-Tropsch condensate into products boiling within the range of liquid fuels. Depending upon the severity of the hydroprocessing operation, a certain proportion of the cracked hydrocarbons may comprise normally gaseous hydrocarbons, such as propane, butane, ethane, and methane. However, the production of these normally gaseous hydrocarbons is usually undesirable, and the processing conditions in the hydroprocessing zone are selected to minimize their manufacture. However, one skilled in the art will recognize that due to the elevated temperature at which the hydrogen-rich normally liquid fraction is recovered from the hydroprocessing zone all of the hydrocarbons present, including those that are normally liquid at ambient temperature, will be in the gaseous state.

In carrying out the process of the present invention the hydroprocessing zone for treatment of the Fischer-Tropsch wax may be either a hydrocracking zone or a hydrotreating zone. Although hydrocracking may be used to improve the pour point and cloud point of the wax fraction, the present invention is most advantageous when the hydroprocessing zone contains hydrotreating catalyst and is operated under hydrotreating conditions. Since the wax fraction is catalytically dewaxed, it is generally unnecessary to employ hydrocracking to meet the target values for properties of the lubricating base oil. In the present scheme, the primary purpose of the hydroprocessing operation is to remove the nitrogen and oxygenates present in the Fischer-Tropsch wax prior to the catalytic dewaxing step. One skilled in the art will recognize that by increasing the severity of the hydroprocessing operation, greater cracking conversion will take place resulting in a lower average molecular weight of the waxy intermediate recovered from the reactor. In some instances this may be advantageous, as for example, if an increased yield of liquid fuels or a lighter weight lubricating base oil product is desired. Generally, however, with the present invention it is desirable to minimize cracking in the hydroprocessing zone in order to maximize the production of the high value lubricating base oils.

As will be explained in greater detail below, the optimal total pressure for carrying out the catalytic dewaxing step is usually lower than the optimal total pressure for performing the hydroprocessing and hydrofinishing steps.

One advantage of the present invention is that it allows the catalytic dewaxing reactor to be operated at a significantly lower pressure than the hydroprocessing and hydrofinishing reactors even though the three reactors are part of the same wax processing train. In one embodiment of the invention the hydroprocessing and hydrofinishing reactors in the wax processing train and the hydrotreating reactor in the condensate processing train are operated at about the same total pressure while the dewaxing reactor is operated at a significantly lower total pressure.

BRIEF DESCRIPTION OF THE DRAWING

The drawing is a schematic representation showing one embodiment of the invention.

DETAILED DESCRIPTION OF THE INVENTION

The present invention will be more clearly understood by referring to the drawing. In the process which constitutes the invention, the Fischer-Tropsch wax and the Fischer-Tropsch condensate are collected separately from the Fischer-Tropsch synthesis reactor (not shown in the drawing). Fischer-Tropsch wax in line 2 is shown as being mixed with hydrogen-rich recycle gas entering via line 4 prior to the wax/hydrogen feed entering the Fischer-Tropsch wax hydrotreating reactor 6 where the nitrogen and oxygenates present in the wax fraction are at least partially removed and at least a portion of the olefins present are saturated. In this embodiment of the process scheme, wax cracking is minimized, but some cracking will still take place resulting in the production of some amount of lower molecular weight material, mostly normally liquid hydrocarbons with some gas. The effluent 8 leaving the Fischer-Tropsch wax hydrotreating reactor is a mixture containing the waxy intermediate, normally liquid hydrocarbons that were formed in the hydrotreating reactor, and hydrogen-rich gas. The effluent from the wax hydrotreating reactor optionally may be cooled to a lower temperature and is passed to a hot high pressure separator 10 where a first vapor fraction comprising a mixture of normally liquid hydrocarbon vapor, primarily lighter products such as naphtha, light diesel, and the hydrogen-rich gas, is separated from a second mixture comprising waxy intermediates and any remaining normally liquid hydrocarbons, generally higher boiling products such as heavy diesel, which are carried by line 12 to a hot low pressure separator 14. In the hot low pressure separator the waxy intermediate is recovered separately from the remaining normally liquid hydrocarbons which is sent by line 16 to the liquid fuels recovery operation that will be discussed in more detail below.

The waxy intermediate carried in line 23 from the hot low pressure separator 14 is mixed with make-up hydrogen 22 and hydrogen-rich recycle gas from line 24 prior to entering the dewaxing unit 26. In an alternative embodiment, the make-up hydrogen in line 22 may be added to line 36 prior to the recycle compressor 38. As will be explained in greater detail later, the dewaxing reactor is preferably operated at a total pressure which is significantly lower than the wax hydrotreating unit 6 and the hydrofinishing unit 30 which are all part of the same wax processing train. In the dewaxing unit the waxy intermediate is catalytically dewaxed in order to improve its properties, such as pour point and viscosity. The lubricating base oil (dewaxed waxy intermediate) is recovered from the dewaxing reactor 26 by line 32 and passed to a separator 34 where the base oil is separated from the hydrogen-rich gas which is recycled to the dewaxing reactor by line 36 and recycle compressor 38 prior to being collected in line 24.

The lubricating base oil recovered by the separator 34 is collected in line 40 where it is mixed with make-up hydrogen from line 42 and with recycled hydrogen from line 44 which has been increased in pressure by recycle compressor 46. The make-up hydrogen from line 42 may alternatively be added to line 82 prior to the recycle compressor 46. The lubricating base oil/hydrogen mixture is carried via line 48 to the hydrofinishing reactor 30. In the hydrofinishing reactor 30 the remaining unsaturated double bonds in the lubricating the base oil molecules are saturated to improve the UV stability of the product. The UV stabilized lubricating base oil is collected in line 52 and sent to a high pressure separator 54 where the lubricating base oil is separated from the hydrogen-rich gas which is recycled to the Fischer-Tropsch wax hydrotreating reactor 6 by line 4. In this embodiment the hydrofinishing reactor 30 and the Fischer-Tropsch wax hydrotreating reactor 6 are both operated at a higher pressure than the dewaxing reactor 26 in order to optimize the processing conditions for each operation. The hydrofinishing reactor is usually operated at a total pressure which is at least as high as the wax hydrotreating reactor and preferably is operated a somewhat higher pressure to compensate for the pressure drop between the hydrofinishing and hydrotreating reactors.

The UV stabilized lubricating base oil from line 52 is carried to a low pressure separator 58 by line 56 where any remaining light hydrocarbons or hydrogen are recovered as overhead gases by line 60. The base oil passes by line 62 to vacuum distillation column 64 where the various base oil fractions are separately recovered which are shown in this embodiment as light lubricating base oil 66, heavy lubricating base oil 68, and bottoms 70.

Returning to the high pressure separator 10, the first vapor fraction comprising a mixture of light hydrocarbon vapor and hydrogen-rich gas is carried by line 72 to the inlet line 74 for the condensate hydrotreating reactor 76 where the normally liquid hydrocarbon vapor fraction is mixed with Fischer-Tropsch condensate 78 coming directly from the Fischer-Tropsch synthesis reactor (not shown). In the condensate hydrotreating reactor 76, oxygenates and nitrogen are removed and the unsaturated double bonds are saturated. The hydrotreated condensate is collected in line 78 and passed to a cold high pressure separator 80 where the hydrogen is separated and sent by line 82 to the recycle compressor 46 for the hydrofinishing reactor 30 located in the wax processing train. Preferably the condensate hydrotreating reactor, hydrofinishing reactor, and wax hydrotreating reactor are all operated at a similarly high pressure so that it is unnecessary to significantly increase the pressure of the recycle gas between each of these reactors in the processing scheme described here. Such operation results in a significant savings in operating costs. The hydrotreated condensate mixture is collected from the high pressure separator 80 by line 84 where it is mixed with the heavy normally liquid hydrocarbons coming from the hot low pressure separator 14. The gas/condensate mixture passes by line 86 to a cold low pressure separator 87 where gas 88 and any moisture 90 are separated out. The liquid oil is collected in line 92 and carried to the fractionation unit 94 where the liquid products, such as naphtha 96 and diesel 98 are collected separately from any remaining light gases 100 and bottoms 102. It will be noted from a review of the drawing and from the previous description that the process scheme which constitutes the invention comprises two integrated processing trains. In the drawing, the major components of the wax processing train comprise the Fischer-Tropsch wax hydrotreating reactor 6, the hot high pressure separator 10, the hot low pressure separator 14, the dewaxing reactor 26, the hydrofinishing reactor 30, the low pressure separator 58, and the vacuum column 64. The major components of the condensate train comprise the condensate hydrotreating reactor 76, the cold high pressure separator 80, the cold low pressure separator 87, and the fractionation unit 94. It should also be noted that the Fischer-Tropsch wax hydrotreating reactor 6, the hydrofinishing reactor 30, and the condensate hydrotreating reactor 76 share a common hydrogen recycle loop and are all operated at a similarly high pressure, i.e., at a total pressure which is significantly higher than the total pressure at which the dewaxing reactor 26 is operated. This integration minimizes the need for incorporating large compressors into the scheme which reduces both capital expenses and operating costs. The dewaxing reactor has its own hydrogen recycle loop which allows it to operate at a lower total pressure optimizing the conditions for the catalytic dewaxing operation.

Fischer-Tropsch Synthesis

During Fischer-Tropsch synthesis, a mixture of hydrocarbons having varying molecular weights are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300 degrees F. to about 700 degrees F. (about 150 degrees C. to about 370 degrees C.), preferably from about 400 degrees F. to about 550 degrees F. (about 205 degrees C. to about 290 degrees C.); pressures of from about 10 psia to about 600 psia (0.7 bars to 41 bars), preferably 30 psia to 300 psia (2 bars to 21 bars); and catalyst space velocities of from about 100 cc/g/hr. to about 10,000 cc/g/hr., preferably 300 cc/g/hr. to 3,000 cc/g/hr.

The products from the Fischer-Tropsch synthesis may range from $C_1$ to $C_{200}$ plus hydrocarbons with a majority in the $C_5$ to $C_{100}$ plus range. The reaction can be conducted in a variety of reactor types, such as, for example, fixed bed reactors containing one or more catalyst beds, slurry reactors, fluidized bed reactors, or a combination of different types of reactors. Such reaction processes and reactors are well known and documented in the literature. The slurry Fischer-Tropsch process, which is preferred in the practice of the invention, utilizes superior heat (and mass) transfer characteristics for the strongly exothermic synthesis reaction and is able to produce relatively high molecular weight paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in European Patent Application No. 0609079, which is completely incorporated herein by reference for all purposes.

Suitable Fischer-Tropsch catalysts comprise one or more catalytic metals such as Fe, Ni, Co, Ru and Re, with cobalt being preferred. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise alumina or titania. Useful catalysts and their preparation are known and illustrated in U.S. Pat. No. 4,568,663, which is intended to be illustrative but non-limiting relative to catalyst selection.

The products as they are recovered from the Fischer-Tropsch operation may be divided into three fractions, a gaseous fraction consisting of very light products, a condensate fraction generally boiling in the range of naphtha and diesel, and a high boiling Fischer-Tropsch wax fraction which is normally solid at ambient temperatures. In the present invention the wax fraction is normally recovered separately from the condensate/light product fraction and sent to the wax processing train. The condensate fraction is preferably separated from the light product fraction prior to being sent to the condensate processing train. The light fraction may be recycled to the Fischer-Tropsch reactor, used to fuel furnaces within the refinery, sold as heating fuel, or flared.

Hydroprocessing

For the purposes of this discussion, the term hydroprocessing is intended to refer to either hydrotreating or hydrocracking. Hydroisomerization and hydrofinishing, while also a type of hydroprocessing, will be treated separately because of their different functions in the process scheme.

As already noted the hydroprocessing reactor in the wax processing train may be either operated as a hydrocracking unit or as a hydrotreating unit. In the process of the present invention the primary purpose of the wax hydroprocessing reactor is to remove oxygenates and nitrogen from the wax prior to feeding it to the dewaxing reactor. The oxygenates and nitrogen in the wax will deactivate the dewaxing catalyst over time. A secondary purpose for the hydroprocessing of the wax may be to improve the lubricating properties, such as pour point and cloud point or to increase the yield of lighter hydrocarbons, such as light lubricating base oils or diesel. In these instances it may be desirable to operate the wax hydroprocessing reactor in a mild hydrocracking mode. However, generally the wax hydroprocessing reactor is preferably operated in a hydrotreating mode in order to minimize cracking conversion. The use of hydrotreating in combination with catalytic dewaxing allows for the production of high quality lubricating base oils which may be used to manufacture premium lubricants or as a blending stock to upgrade lower quality base oils which otherwise would fail to meet product specifications.

Hydrotreating refers to a catalytic process, usually carried out in the presence of free hydrogen, in which the primary purpose when used to process conventional petroleum derived feedstocks is the removal of various metal contaminants, such as arsenic; heteroatoms, such as sulfur and nitrogen; and aromatics from the feedstock. As already noted, the primary purpose for hydrotreating the Fischer-Tropsch products is to remove the oxygenates and nitrogen from the feedstock. In the condensate processing train the hydrotreating process also is used to saturate the olefins present. Generally, in hydrotreating operations cracking of the hydrocarbon molecules, i.e., breaking the larger hydrocarbon molecules into smaller hydrocarbon molecules is minimized. For the purpose of this discussion the term hydrotreating refers to a hydroprocessing operation in which the conversion is 20 percent or less, where the extent of "conversion" relates to the percentage of the feed boiling above a reference temperature (e.g., 700 degrees F.) which is converted to products boiling below the reference temperature.

Hydrocracking refers to a catalytic process, usually carried out in the presence of free hydrogen, in which the cracking of the larger hydrocarbon molecules is the primary purpose of the operation. In contrast to hydrotreating, the conversion rate for hydrocracking, for the purpose of this disclosure, is defined as more than 20 percent. Removal of the oxygenates as well as denitrification of the waxy feedstock also will occur. In the present invention, cracking of the hydrocarbon molecules may be used to increase the yield of diesel and to reduce the amount of heavy Fischer-Tropsch fraction passing through the catalytic dewaxing operation.

Catalysts used in carrying out hydrotreating and hydrocracking operations are well known in the art. See for example U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, or more preferably or possibly, as sulfides when such compounds are readily formed from the particular metal involved. Preferred non-noble metal catalyst compositions contain in excess of about 5 weight percent, preferably about 5 weight percent to about 40 weight percent molybdenum and/or tungsten, and at least about 0.5, and generally about 1 weight percent to about 15 weight percent of nickel and/or cobalt determined as the corresponding oxides. Catalysts containing noble metals, such as platinum, contain in excess of 0.01 percent metal, preferably between about 0.1 percent to about 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VIB components, i.e., molybdenum and tungsten can be combined with the refractory oxide by impregnation, co-mulling or co-precipitation. Although these components can be combined with the catalyst matrix as the sulfides, that is generally not preferred, as the sulfur compounds can interfere with the Fischer-Tropsch catalysts.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so called ultra stable zeolite Y and high structural silica-alumina ratio zeolite Y such as that described in U.S. Pat. Nos. 4,401,556; 4,820,402; and 5,059,567. Small crystal size zeolite Y, such as that described in U.S. Pat. No. 5,073,530 can also be used. Non-zeolitic molecular sieves which can be used include, for example, silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO) and U.S. Pat. No. 4,913,799 and the various references cited in U.S. Pat. No. 4,913,799.

Mesoporous molecular sieves can also be used, for example the M41S family of materials as described in J. Am. Chem. Soc., 114:10834-10843 (1992), MCM-41; U.S. Pat. Nos. 5,246,689; 5,198,203; and 5,334,368; and MCM-48

(Kresge et al., Nature 359:710 (1992)). Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia-zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification. In performing the hydrocracking and/or hydrotreating operation, more than one catalyst type may be used in the reactor. The different catalyst types can be separated into layers or mixed.

Hydrocracking conditions have been well documented in the literature. In general, the overall LHSV is about 0.1 $hr^{-1}$ to about 15.0 $hr^{-1}$ (v/v), preferably from about 0.3 $hr^{-1}$ to about 3.0 $hr^{-1}$. The reaction pressure generally ranges from about 500 psig to about 3000 psig (about 3.4 MPa to about 20.4 MPa), preferably from about 500 psig to about 1500 psig (about 3.4 MPa to about 10.2 MPa). Hydrogen circulation rate are typically greater than 500 SCF/Bbl. Temperatures in the reactor will range from about 400 degrees F. to about 950 degrees F. (about 205 degrees C. to about 510 degrees C.), preferably ranging from about 650 degrees F. to about 850 degrees F. (about 343 degrees C. to about 455 degrees C.).

Typical hydrotreating conditions vary over a wide range. In general, the overall LHSV is about 0.5 to 15.0. The total pressure in the reactor generally ranges from about 200 psig to about 2000 psig. Hydrogen recirculation rates are typically greater than 200 SCF/Bbl, and are preferably between 1000 SCF per barrel and 5000 SCF per barrel. Temperatures in the reactor will range from about 400 degrees F. to about 800 degrees F. (about 205 degrees C. to about 427 degrees C.).

In order to take full advantage of the present invention, the pressure in the two hydroprocessing reactors, i.e., the wax hydroprocessing reactor and the condensate hydrotreating reactor, are preferably maintained at about the same pressure as in the hydrofinishing reactor. In general, this means that the total pressure in each of the hydroprocessing reactors will be within the range of from about 300 psig to about 3000 psig, preferably within the range of from about 500 psig to about 1500 psig, and most preferably within the range of from about 800 psig to about 1200 psig. As already noted, when operated in this manner the hydrogen recycle loops which integrate the three reactors do not require the large recycle compressors generally required in most conventional schemes.

One skilled in the art will recognize that the two hydroprocessing reactors and the hydrofinishing reactors will not necessarily be operated at exactly the same total pressure, since a pressure drop in the hydrogen recycle loop would be expected. Consequently, the hydrofinishing reactor is normally operated at a slightly higher total pressure than the wax hydroprocessing reactor. When the pressure in the various reactors is described as being at about the same total pressure, what is meant is that the reactors are operated at substantially the same total pressure with a difference in pressure falling within a range that is attributable to normal pressure drop within the system. In general, the pressure drop would be expected to fall within the range from about 20 psig and about 150 psig depending on a number of factors which would be recognized by one skilled in the art. The intent here is to minimize the need for the use of recycle compressors while maintaining the conditions, especially the total pressure, in the reactor within their optimal operating range.

Catalytic Dewaxing

Catalytic dewaxing consists of three main classes, conventional hydrodewaxing, complete hydroisomerization dewaxing, and partial hydroisomerization dewaxing. All three classes involve passing a mixture of a waxy hydrocarbon stream and hydrogen over a catalyst that contains an acidic component to reduce the normal and slightly branched isoparaffins in the feed and increase the proportion of other non-waxy species. The method selected for dewaxing a feed typically depends on the product quality, and the wax content of the feed, with conventional hydrodewaxing often preferred for low wax content feeds. The method for dewaxing can be effected by the choice of the catalyst. The general subject is reviewed by Avilino Sequeira, in Lubricant Base Stock and Wax Processing, Marcel Dekker, Inc., pages 194-223. The determination between conventional hydrodewaxing, complete hydroisomerization dewaxing, and partial hydroisomerization dewaxing can be made by using the n-hexadecane isomerization test as described in U.S. Pat. No. 5,282,958. When measured at 96 percent, n-hexadecane conversion using conventional hydrodewaxing catalysts will exhibit a selectivity to isomerized hexadecanes of less than 10 percent, partial hydroisomerization dewaxing catalysts will exhibit a selectivity to isomerized hexadecanes of greater than 10 percent to less than 40 percent, and complete hydroisomerization dewaxing catalysts will exhibit a selectivity to isomerized hexadecanes of greater than or equal to 40 percent, preferably greater than 60 percent, and most preferably greater than 80 percent.

In conventional hydrodewaxing, the pour point is lowered by selectively cracking the wax molecules mostly to smaller paraffins using a conventional hydrodewaxing catalyst, such as, for example ZSM-5. Metals may be added to the catalyst, primarily to reduce fouling. In the present invention conventional hydrodewaxing also may be used to increase the yield of diesel in the final product slate by cracking the Fischer-Tropsch wax molecules.

Complete hydroisomerization is generally preferred for dewaxing the waxy feed in the present invention. Complete hydroisomerization dewaxing typically achieves high conversion levels of wax by isomerization to non-waxy isoparaffins while at the same time minimizing the conversion by cracking. Since wax conversion can be complete, or at least very high, this process typically does not need to be combined with additional dewaxing processes to produce a lubricating oil base stock with an acceptable pour point. Complete hydroisomerization dewaxing uses a dual-functional catalyst consisting of an acidic component and an active metal component having hydrogenation activity. Both components are required to conduct the isomerization reaction. The acidic component of the catalysts used in complete hydroisomerization preferably includes an intermediate pore SAPO, such as SAPO-11, SAPO-31, and SAPO41, with SAPO-11 being particularly preferred. Intermediate pore zeolites, such as ZSM-22, ZSM-23, SSZ-32, ZSM-35, and ZSM-48, also may be used in carrying out complete hydroisomerization dewaxing. Typical active metals include molybdenum, nickel, vanadium, cobalt, tungsten, zinc, platinum, and palladium. The metals platinum and palladium are especially preferred as the active metals, with platinum most commonly used.

In partial hydroisomerization dewaxing, a portion of the wax is isomerized to iso-paraffins using catalysts that can isomerize paraffins selectively, but only if the conversion of wax is kept to relatively low values (typically below 50 percent). At higher conversions, wax conversion by cracking becomes significant, and yield losses of lubricating base stock become uneconomical. Like complete hydroisomerization dewaxing, the catalysts used in partial hydroisomerization dewaxing include both an acidic component and a hydrogenation component. The acidic catalyst components useful for partial hydroisomerization dewaxing include amorphous silica-aluminas, fluorided alumina, and 12-ring zeolites (such as Beta, Y zeolite, L zeolite). The hydrogenation component of the catalyst is the same as already discussed with complete hydroisomerization dewaxing. Because the wax conversion is incomplete, partial hydroisomerization dewaxing must be supplemented with an additional dewaxing technique, typically solvent dewaxing, complete hydroisomerization dewaxing, or conventional hydrodewaxing in order to produce a lubricating base stock with an acceptable pour point (below about +10 degrees F. or −12 degrees C.).

In preparing those catalysts containing a non-zeolitic molecular sieve and having a hydrogenation component for use in the present invention, the metal may be deposited on the catalyst using a non-aqueous method. Catalysts, particularly catalysts containing SAPO's, on which the metal has been deposited using the non-aqueous method, have shown greater selectivity and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, non-reactive solvent and depositing it on the molecular sieve by ion exchange or impregnation.

Typical conditions for catalytic dewaxing as used in the present process involve temperatures from about 400 degrees F. to about 800 degrees F. (about 200 degrees C. to about 425 degrees C.) and space velocities from about 0.2 to 5 $hr^{-1}$. The total pressure in the dewaxing reactor will usually fall within the range of from about 15 psig to about 1500 psig, preferably from about 150 psig to about 1000 psig, and most preferably from about 300 psig to about 500 psig. As already noted the optimal pressure for the catalytic dewaxing process is usually significantly lower than the pressure employed in the hydroprocessing units and the hydrofinishing unit. Therefore, in the present invention the total pressure in the dewaxing reactor will almost always be significantly below the total pressure in the hydroprocessing reactors and the hydrofinishing reactor.

Hydrofinishing

Hydrofinishing operations are intended to improve the UV stability and color of the lubricating base oil products. It is believed this is accomplished by saturating the double bonds present in the hydrocarbon molecule. A general description of the hydrofinishing process may be found in U.S. Pat. Nos. 3,852,207 and 4,673,487. As used in this disclosure, the term UV stability refers to the stability of the lubricating base oil when exposed to ultraviolet light and oxygen. Instability is indicated when a visible precipitate forms or darker color develops upon exposure to ultraviolet light and air which results in a cloudiness or floc in the product. Lubricating base oils prepared by the process of the present invention will require UV stabilization before they are suitable for use in the manufacture of commercial lubricating oils.

In the present invention, the total pressure in the hydrofinishing reactor will be between about 300 psig and about 3000 psig, preferably between about 500 psig and about 1500 psig, and most preferably between about 800 psig and about 1200 psig. In general, in order to eliminate the necessity for a compressor in the hydrogen recycle loop between the hydrofinishing reactor and the wax hydroprocessing reactor, the hydrofinishing reactor will be operated at a total pressure at least 50 psig above the total pressure in the hydroprocessing reactor. Temperature ranges in the hydrofinishing zone are usually in the range of from about 300 degrees F. (150 degrees C.) to about 700 degrees F. (370 degrees C.), with temperatures of from about 400 degrees F. (205 degrees C.) to about 500 degrees F. (260 degrees C.) being preferred. The LHSV is usually within the range of from about 0.2 to about 2.0, preferably 0.2 to 1.5, and most preferably from about 0.7 to 1.0. Hydrogen is usually supplied to the hydrofinishing zone at a rate of from about 1000 SCF per barrel to about 10,000 SCF per barrel of feed. Typically, the hydrogen is fed at a rate of about 3000 SCF per barrel of feed.

Suitable hydrofinishing catalysts typically contain a Group VIIIA noble metal component together with an oxide support. Metals or compounds of the following metals are contemplated as useful in hydrofinishing catalysts include ruthenium, rhodium, iridium, palladium, platinum, and osmium. Preferably, the metal or metals will be platinum, palladium or mixtures of platinum and palladium. The refractory oxide support usually consists of silica-alumina, silica-alumina-zirconia, and the like. Typical hydrofinishing catalysts are disclosed in U.S. Pat. Nos. 3,852,207; 4,157,294; and 4,673,487.

What is claimed is:

1. An integrated process for producing Fischer-Tropsch derived products boiling in the range of liquid fuel and lubricating base oil which comprises:

(a) recovering separately from a Fischer-Tropsch synthesis reactor a Fischer-Tropsch wax and a Fischer-Tropsch condensate;

(b) hydroprocessing the Fischer-Tropsch wax in a wax hydroprocessing zone by contacting the Fischer-Tropsch wax with a hydroprocessing catalyst in the presence of hydrogen under hydroprocessing conditions and recovering from the wax hydroprocessing zone a waxy intermediate and a hydrogen-rich normally liquid fraction;

(c) mixing the Fischer-Tropsch condensate from step (a) and at least part of the hydrogen-rich normally liquid fraction from step (b) to form a Fischer-Tropsch condensate mixture;

(d) hydrotreating the Fischer-Tropsch condensate mixture in a condensate hydrotreating zone by contacting the Fischer-Tropsch condensate mixture with a hydrotreating catalyst in the presence of hydrogen under hydrotreating conditions and recovering from the condensate hydrotreating zone a hydrotreated Fischer-Tropsch condensate product;

(e) recovering from the hydrotreated Fischer-Tropsch condensate product a Fischer-Tropsch derived hydrocarbon boiling within the range of liquid fuel;

(f) dewaxing the waxy intermediate from step (b) in a catalytic dewaxing zone by contacting the waxy intermediate with a dewaxing catalyst in the presence hydrogen under dewaxing conditions and recovering a base oil from the dewaxing zone;

(g) hydrofinishing the base oil from step (f) in a hydrofinishing zone by contacting the base oil with a hydrofinishing catalyst in the presence of hydrogen under hydrofinishing conditions;

(h) recovering from the hydrofinishing zone a UV stabilized lubricating base oil and a hydrogen-rich gas; and (i) recycling the hydrogen-rich gas from step (h) to the wax hydroprocessing zone of step (b) and wherein the total pressure in the hydrofinishing zone is at least as high as the total pressure in the wax hydroprocessing zone.

2. The process of claim 1 wherein the total pressure in the hydrofinishing zone is at least about 50 psig higher than the total pressure in the wax hydroprocessing zone.

3. The process of claim 1 wherein the total pressure in the hydrofinishing zone is within the range of from about 300 psig to about 3000 psig.

4. The process of claim 3 wherein the total pressure in the hydrofinishing zone is within the range of from about 500 psig to about 1500 psig.

5. The process of claim 4 wherein the total pressure in the hydrofinishing zone is within the range of from about 800 psig to about 1200 psig.

6. The process of claim 1 wherein the wax hydroprocessing zone is a wax hydrotreating zone containing hydrotreating catalyst and operating under hydrotreating conditions.

7. The process of claim 1 wherein the wax hydroprocessing zone is a wax hydrocracking zone containing hydrocracking catalyst and operating under hydrocracking conditions.

8. The process of claim 1 wherein the dewaxing zone is operated at a total pressure which is less than the total pressure of the hydrofinishing zone.

9. The process of claim 8 wherein the total pressure in the dewaxing zone is within the range of from about 15 psig to about 1500 psig.

10. The process of claim 9 wherein the total pressure in the dewaxing zone is within the range of from about 150 psig to about 1000 psig.

11. The process of claim 10 wherein the total pressure in the dewaxing zone is within the range of from about 300 psig to about 500 psig.

12. The process of claim 8 wherein the dewaxing zone is maintained under conditions for complete hydroisomerization dewaxing.

13. The process of claim 12 wherein the dewaxing zone contains an intermediate pore SAPO.

14. The process of claim 13 wherein the intermediate pore SAPO is selected from the group consisting of SAPO-11, SAPO-31, and SAPO-41.

15. The process of claim 1 wherein the wax hydroprocessing zone and the condensate hydrotreating zone are operated at about the same total pressure.

16. The process of claim 1 wherein the normally liquid fraction recovered in step (b) includes diesel.

17. The process of claim 1 wherein the normally liquid fraction recovered in step (b) includes naphtha.

* * * * *